US008876231B2

(12) United States Patent
Chen

(10) Patent No.: US 8,876,231 B2
(45) Date of Patent: Nov. 4, 2014

(54) ADAPTER KIT OF SLIDE MODULE

(71) Applicant: Martas Precision Slide Co., Ltd., New Taipei (TW)

(72) Inventor: Wan-Lai Chen, New Taipei (TW)

(73) Assignee: Martas Precision Slide Co., Ltd., New Taipei (TW)

( * ) Notice: Subject to any disclaimer, the term of this patent is extended or adjusted under 35 U.S.C. 154(b) by 97 days.

(21) Appl. No.: 13/799,001

(22) Filed: Mar. 13, 2013

(65) Prior Publication Data

US 2014/0265785 A1 Sep. 18, 2014

(51) Int. Cl.
*A47B 88/04* (2006.01)

(52) U.S. Cl.
CPC ..... *A47B 88/04* (2013.01)
USPC ..... 312/334.6; 312/334.14

(58) Field of Classification Search
CPC ..... A47B 88/04; A47B 88/0418; A47B 2088/04; A47B 2088/0418; A47B 2210/091
USPC ..... 312/330.1, 334.1, 334.6, 334.13, 312/334.14, 334.27, 334.31, 334.32, 312/334.34; 384/18, 19, 20, 22
See application file for complete search history.

(56) References Cited

U.S. PATENT DOCUMENTS

| | | | | |
|---|---|---|---|---|
| 5,779,333 | A * | 7/1998 | Lautenschlager | 312/334.15 |
| 7,597,413 | B2 * | 10/2009 | Fitz | 312/334.15 |
| 7,845,744 | B2 * | 12/2010 | Chen et al. | 312/334.6 |
| 2004/0000851 | A1 * | 1/2004 | Lam Harn et al. | 312/334.7 |
| 2007/0057609 | A1 * | 3/2007 | Lam et al. | 312/334.31 |
| 2008/0157643 | A1 * | 7/2008 | Chen | 312/334.6 |

* cited by examiner

*Primary Examiner* — James O Hansen
(74) *Attorney, Agent, or Firm* — Rosenberg, Klein & Lee

(57) ABSTRACT

An adapter kit of a slide module includes a fixing rack and an external frame coupled with an inner rail and an outer rail respectively and is installed between a drawer and a cabinet. First and second side boards are disposed on both sides of the fixing rack respectively, and the second side board has at least one folded portion and at least one level difference portion. First and second bent portions corresponding to the first and second side boards are disposed on both sides of the external frame respectively, thus the first bent portion and the folded portion can be latched with each other, and an inner surface of the second bent portion abuts the level difference portion to form two support structures to enhance the strength. The adapter kit can be used with various slide modules to provide a hidden slide design and lower the development cost.

12 Claims, 8 Drawing Sheets

ADAPTER KIT OF SLIDE MODULE

BACKGROUND OF THE INVENTION

1. Field of the Invention

The present invention relates to the field of slide structures, and more particularly to an adapter kit that can be combined with a conventional slide to provide a hidden slide design.

2. Description of the Related Art

Slide is used extensively in furniture such as file cabinets, cupboards and tables to facilitate users to push or pull a drawer to slide. Common slides are divided according to sliding length into two types, respectively: a fully extendable three-piece slide module capable of carrying a heavier load and a three-quarter extendable two-piece slide module capable of carrying a lighter load. Either one of the aforementioned types of the slide modules includes at least one inner rail, an outer rail and at least one slide element coupled between the inner rail and the outer rail, wherein the outer rail and the inner rail are manufactured by bending and shaping a steel material.

Since most of the present slide modules are installed between a side of a drawer and an inner side of a piece of furniture, the slide module has a cross-section in a long flat shape with the shorter sides much smaller than the longer sides to facilitate users to install the slide module into a gap between the drawer and the furniture. In installation, the two longer sides are fixed onto a side of the drawer and an inner side of the furniture respectively, thus resulting in a smaller installation cross-section. The long flat shaped slide module can improve lateral strength to prevent the problem of drooping the slide or the drawer due to heavy weight.

On the other hand, some hidden slide modules available in the market are designed for the aesthetic purpose, and the hidden slide modules are installed between the bottom of the drawer and the inner bottom of the furniture. Since the slide modules cannot be seen from any side when the drawer is pulled out, therefore they are called "hidden slide modules". However, the weight of the drawer presses down on the hidden slide modules after the drawer is pulled out, and the force acting direction is different from that of the general slide modules, so that the hidden slide modules have a cross-section in a rectangular shape. Unlike the long flat shaped design of the general slide modules, the rectangular shaped slide modules can bear a heaver load. To enhance the buffering function of closing the drawer, it is necessary to redesign the structure and thus increasing the development and manufacturing costs significantly. When the strength is taken into consideration and the general slide with a buffering function available in the market cannot be applied, the hidden slide module with the buffering function for closing the drawer has drawbacks including a poor buffering smoothness, a too-short buffering time, and an insufficient buffering distance. Sometimes, the buffering function is poor or even disabled when the drawer is slammed into its slot. In view of the drawbacks of the conventional slide module, the inventor of the present invention provided an improved slide module to overcome the complicated structure, uneasy manufacture and high price of the conventional slide module.

SUMMARY OF THE INVENTION

Therefore, it is a primary objective of the present invention to overcome the problems of the prior art by providing an adapter kit of a slide module. The adapter kit is used together with various slide modules available in the market and the adapter kit comes with a hidden slide design, not only saving the repeated development costs, but also providing good strength for its use to prevent the drooping issue effectively. In summation, the present invention can overcome the aforementioned problems including the complicated structure, uneasy manufacture and high price.

To achieve the aforementioned objective, the present invention provides an adapter kit of a slide module, and the adapter kit is installed between a drawer and a cabinet, and the slide module is hidden and installed at the bottom of the drawer, wherein the slide module comprises an inner rail, an outer rail and a slide element, and the slide element is installed between the inner rail and the outer rail, and the outer rail can be moved linearly with respect to the inner rail. The adapter kit comprises: a fixing rack, having a first side board and a second side board disposed on two sides of the fixing rack respectively to form an L-shaped structure, and the first side board having a plurality of first fixing holes for mounting the first side board onto an inner side of the cabinet, and the second side board having at least one folded portion and at least one level difference portion, and the level difference portion having a plurality of second fixing holes corresponding to the inner rail, for fixing the inner rail to the level difference portion; and an external frame, covered onto the exterior of the outer rail and coupled to the fixing rack, and the top of the external frame being fixed to the bottom of the drawer, and the external frame having a first bent portion coupled to an edge of the folded portion, and the first bent portion and the folded portion being latched with each other to form a first support structure, and the external frame having a second bent portion coupled to an edge of the level difference portion, and an inner surface of the second bent portion being coupled to an outer surface of the level difference portion to form a second support structure.

Wherein, the level difference portion has a height corresponding to the thickness of the second bent portion, and the thickness for its use can be reduced effectively while providing good strength.

In a preferred embodiment, the adapter kit of a slide module according to the present invention further comprises at least one positioning hook installed at an end of the external frame and in a direction towards the other end, and the drawer having a first positioning hole formed at a position opposite to the positioning hook, such that when the drawer is assembled, the positioning hook is latched into the first positioning hole. Therefore, the present invention provides an easy installation and a high stability of the assembly.

In a preferred embodiment, the adapter kit of a slide module according to the present invention further comprises an adjusting structure installed on a side of the external frame, and the adjusting structure includes an adjusting plate and an adjusting screw, and the adjusting plate is extended outwardly from the external frame, and the adjusting plate has a screw hole for screwing the adjusting screw, and the drawer has a second positioning hole formed at a position corresponding to the adjusting screw, and an end of the adjusting screw is accommodated in the second positioning hole for adjusting the gap of the drawer with respect to the cabinet and enhance the aesthetic look of the product when use.

Wherein, the external frame has a latch portion formed separately at two edges of the external frame, and the latch portions are formed by bending a section of each latch portion adjacent to the edge of the external frame towards the center of each latch portion, and the outer rail is covered completely in the latch portion to prevent components of the assembly from falling out.

Wherein, the folded portion is disposed at an end position of a movement track of the outer rail and can be latched with the first support structure when the outer rail is pulled outwardly to the outmost position.

Wherein, the level difference portion has a length corresponding to a moving distance of the slide module, and the second bent portion has a length within 25%-50% of the length of the level difference portion, so as to provide a contact surface required by the level difference portion and enhance the support strength significantly.

DETAILED DESCRIPTION OF THE PREFERRED EMBODIMENTS

The technical content of the present invention will become apparent with the detailed description of preferred embodiments and the illustration of related drawings as follows.

Figure 1:
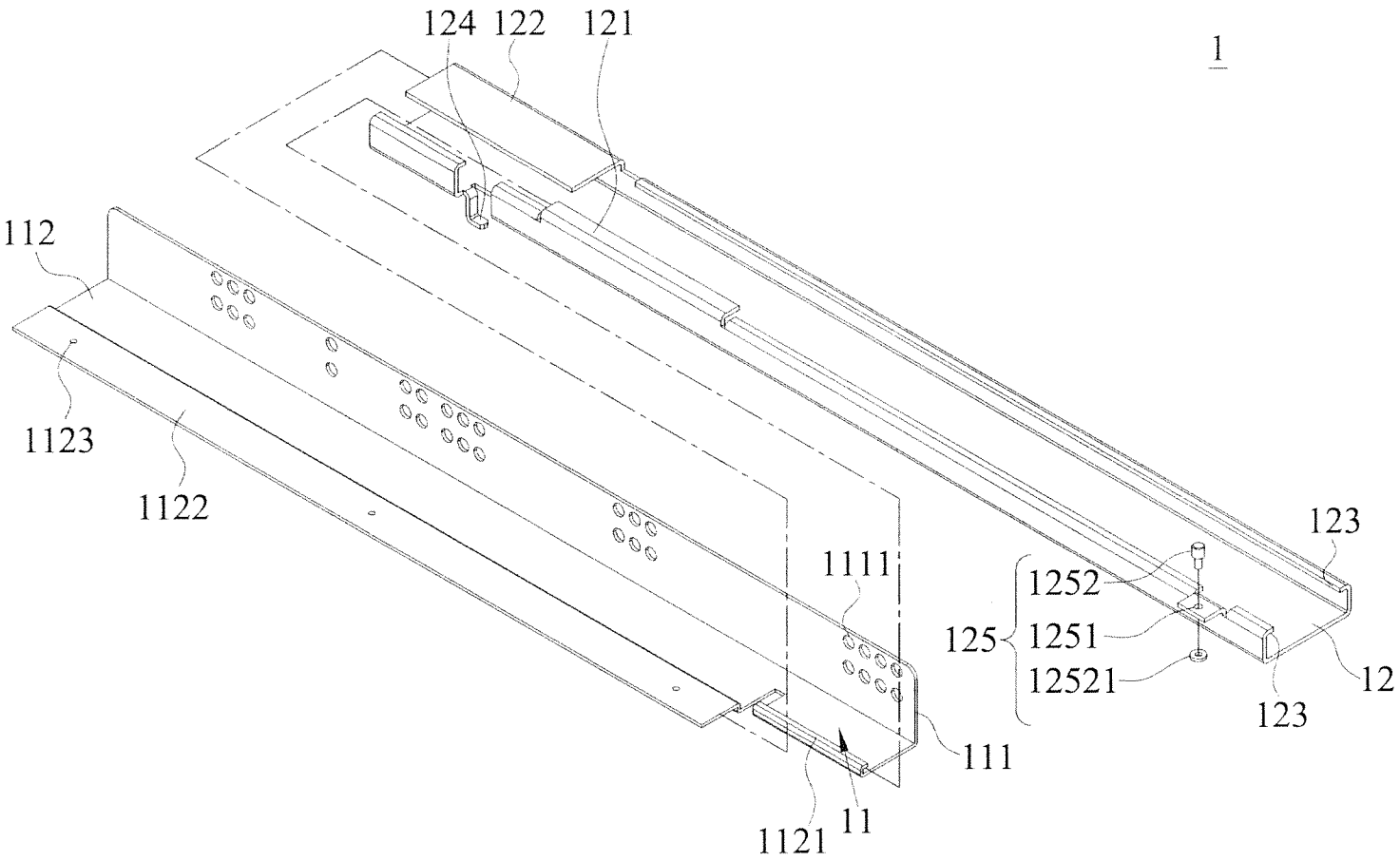
FIG. 1 is an exploded view of a preferred embodiment of the present invention.
Figure 2A:
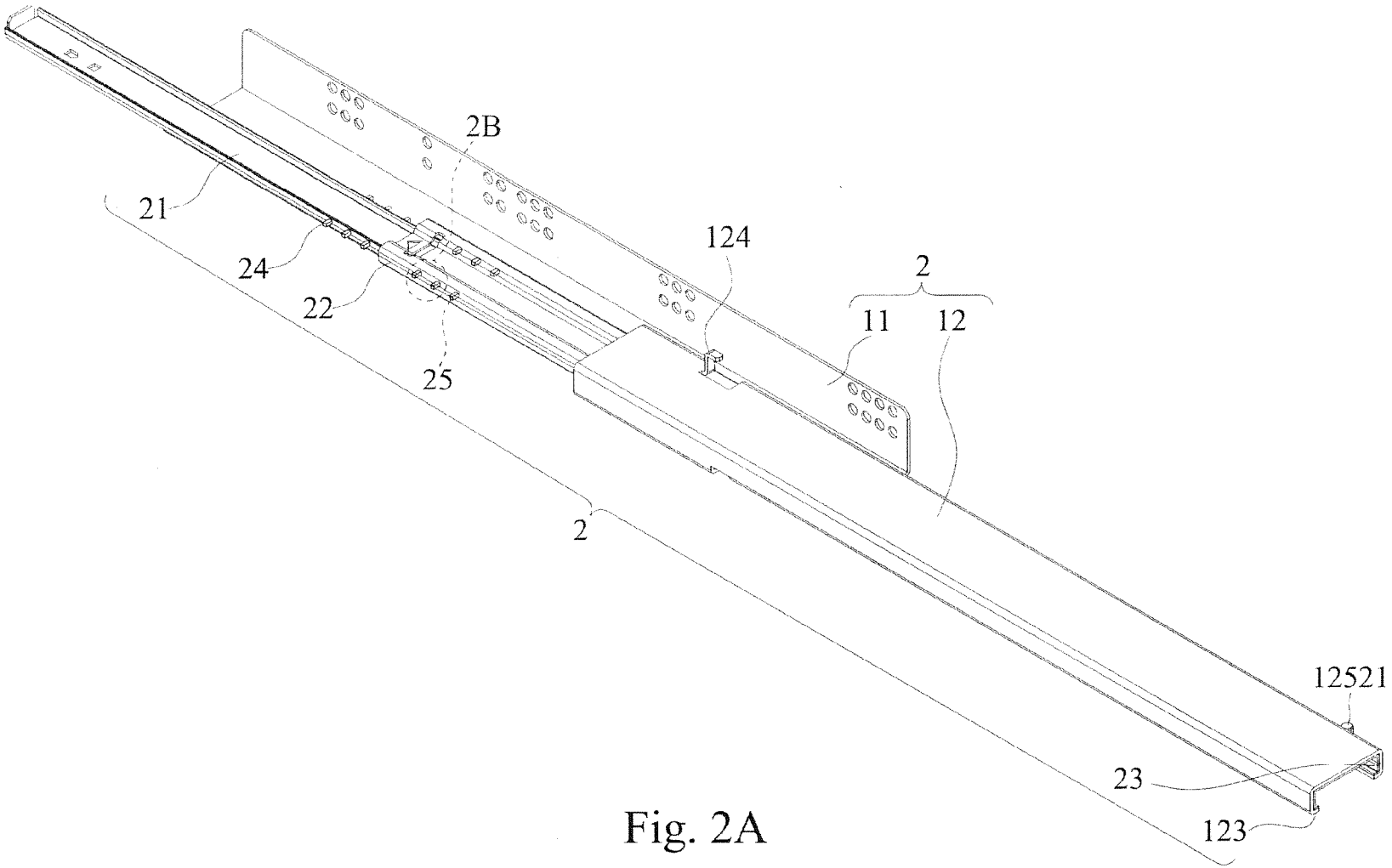
FIG. 2A is a perspective view of a preferred embodiment of the present invention.
Figure 2B:
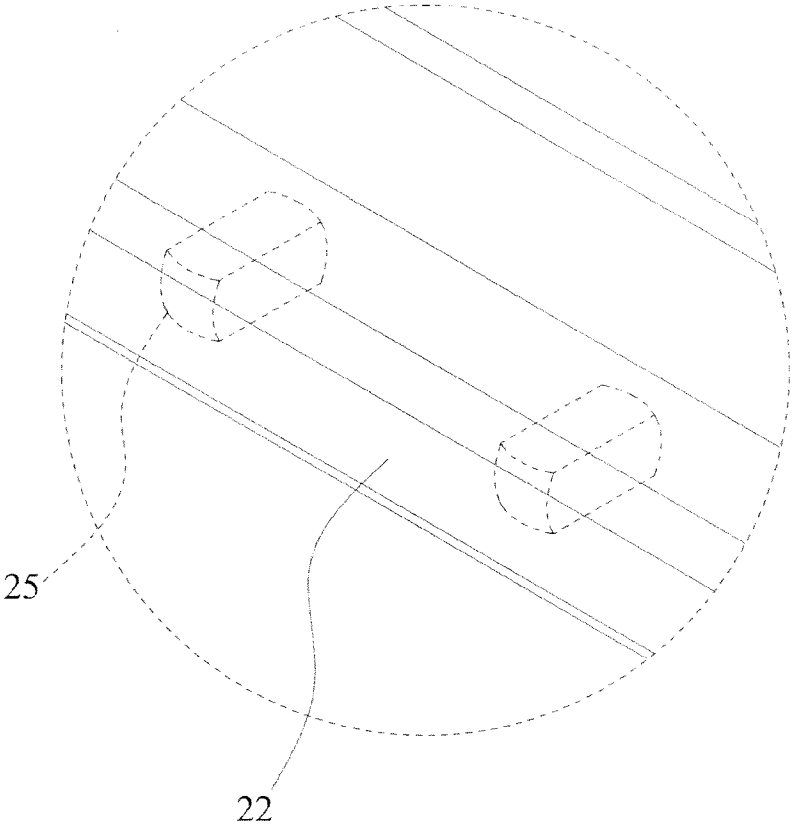
FIG. 2B is a partial blow-up view of a FIG. 2A.
Figure 3:
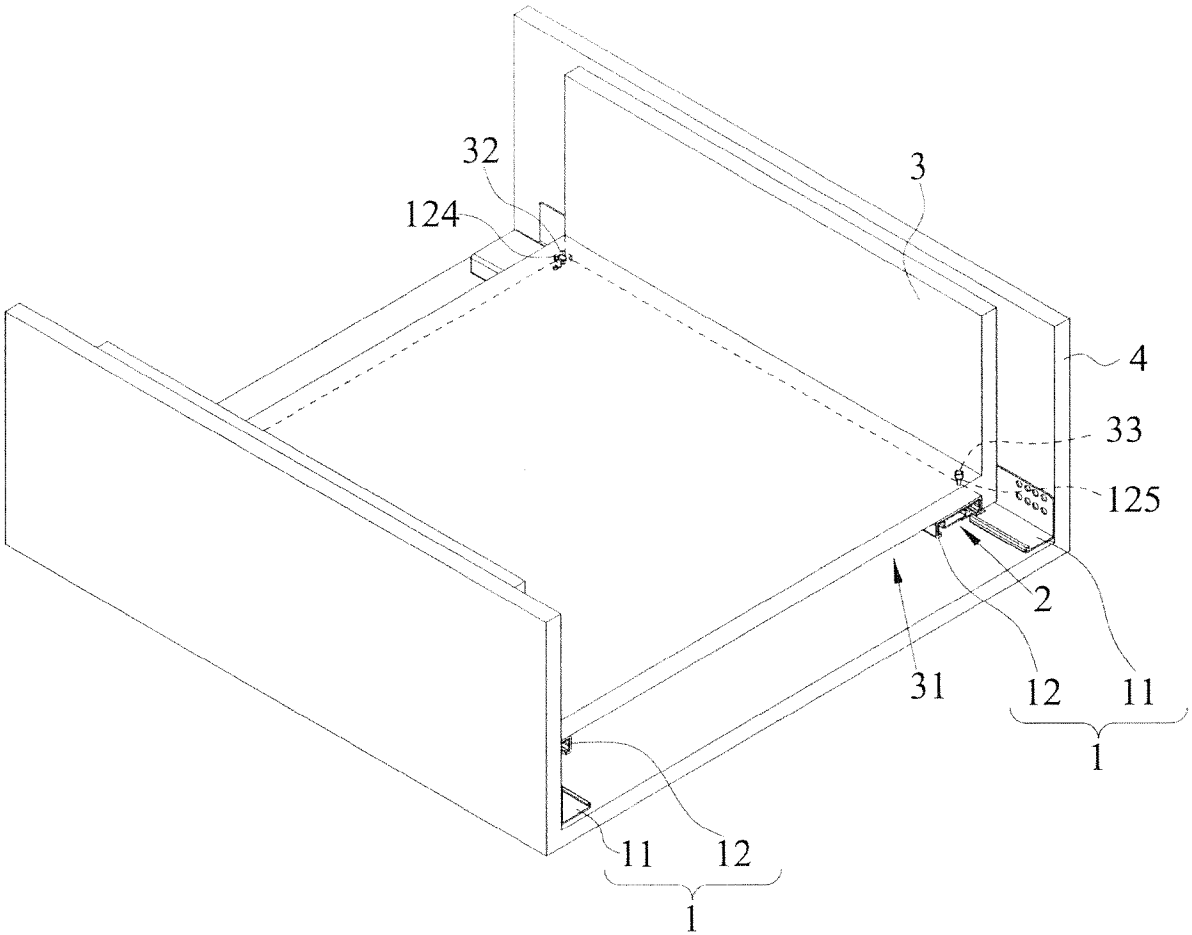
FIG. 3 is a schematic view of an installation in accordance with a preferred embodiment of the present invention.

With reference to FIGS. 1 to 3 for an exploded view, a perspective view and a schematic view of an adapter kit of a slide module in accordance with a preferred embodiment of the present invention respectively, the adapter kit 1 comprises a fixing rack 11 and an external frame 12, provided for covering onto the exterior of a slide module 2 and installing between a drawer 3 and a cabinet 4, such that the slide module 2 is hidden and installed at the bottom of the drawer. The slide module 2 comprises an inner rail 21, a middle rail 22, an outer rail 23, a first slide element 24 and a second slide element 25, and the first slide element 24 is movably installed between the inner rail 21 and the middle rail 22, and the second slide element 25 is movably installed between the middle rail and the outer rail 23, such that the outer rail 23 can be moved linearly with respect to the middle rail 22 and the inner rail 21.

Wherein, the fixing rack 11 is manufactured by bending a metal sheet into an L-shaped structure, and the fixing rack 11 has a first side board 111 and a second side board 112 formed on two sides of the fixing rack 11 respectively, and the first side board and second side board 111, 112 are perpendicular to each other. The first side board 111 has a plurality of first fixing holes 1111 fixed to an inner side of the cabinet 4, and the second side board 112 is stamped and bent into a folded portion 1121 and a level difference portion 1122 and installed with an interval apart from each other between the folded portion 1121 and the level difference portion 1122. The level difference portion 1122 has a plurality of second fixing holes 1123 corresponding to the inner rail 21 for fixing the inner rail 21 to the level difference portion 1122. In addition, the folded portion 1121 is bent in the same direction twice to form a C-shaped structure and installed at an end position of a movement track of the outer rail 23 corresponding to the second side board 112. In addition, the level difference portion 1122 is formed by bending the second side board 112 twice in different directions to form a plane protruded toward the first side board 111, and the level difference portion 1122 is parallel to the second side board 112.

The external frame 12 is manufactured by bending a metal sheet into an n-shaped structure, covered onto the exterior of the outer rail 23, and coupled to the fixing rack 11, and the top of the external frame 12 is fixed to the bottom of the drawer 31 and the bottom of the drawer 3 has a containing space 31 corresponding to the adapter kit 1. In addition, the external frame 12 has a first bent portion 121 coupled to a side of the folded portion 1121, and the first bent portion 121 and the folded portion 1121 are latched with each other to form a first support structure (not labeled). The external frame 12 has a second bent portion 122 coupled to a side of the level difference portion 1122 and an inner surface of the second bent portion 122 abuts an outer surface of the level difference portion 1122 to form a second support structure (not labeled). It is noteworthy that the level difference portion 1122 has a height corresponding to the thickness of the second bent portion 122 to reduce the thickness for its use effectively. To enhance the support strength for applications, the level difference portion 1122 has a length corresponding to the moving distance of the slide module 2, and the second bent portion 122 has a length falling within a range of 25%~50% of the level difference portion 1122. In addition, a latch portion 123 is formed separately on both edges of the external frame 12, and manufactured by bending a section adjacent to an edge of the external frame 12 towards the center to cover the exterior of the outer rail 23 completely to prevent components from falling out.

To facilitate the assembling process and enhance the stability of the assembly effectively, the external frame 12 has a positioning hook 124 retracted into an end of the cabinet 4, and the positioning hook 124 is installed in a direction towards the other end of the cabinet 4, and the drawer 32 has a first positioning hole 32 disposed at a position corresponding to the positioning hook 124. In the process of assembling the adapter kit of a slide module of the present invention to the drawer 32, the positioning hook 124 is latched into the first positioning hole 32.

To adjust the gap of the drawer 3 with respect to the cabinet 4 and improve the aesthetic look, an adjusting structure 125 is installed to a side of the external frame 12. The external frame 12 includes an adjusting plate 1251 and an adjusting screw 1252, wherein the adjusting plate 1251 is extended outwardly from the external frame 12, and the adjusting plate 1251 has a screw hole 12511 for screwing and installing the adjusting screw 1252, and a prop member 12521 installed to an end of the adjusting screw 1252. The drawer 3 has a second positioning hole 33 corresponding to the adjusting screw 1252, so that the prop member 12521 can be contained and installed in the second positioning hole 33. By adjusting the length of ascending or descending the adjusting screw 1252, the distance between the drawer 3 and the slide module 2 can be changed to achieve the effect of adjusting the gap of the drawer 3 with respect to the cabinet 4 effectively.

Figure 4A:
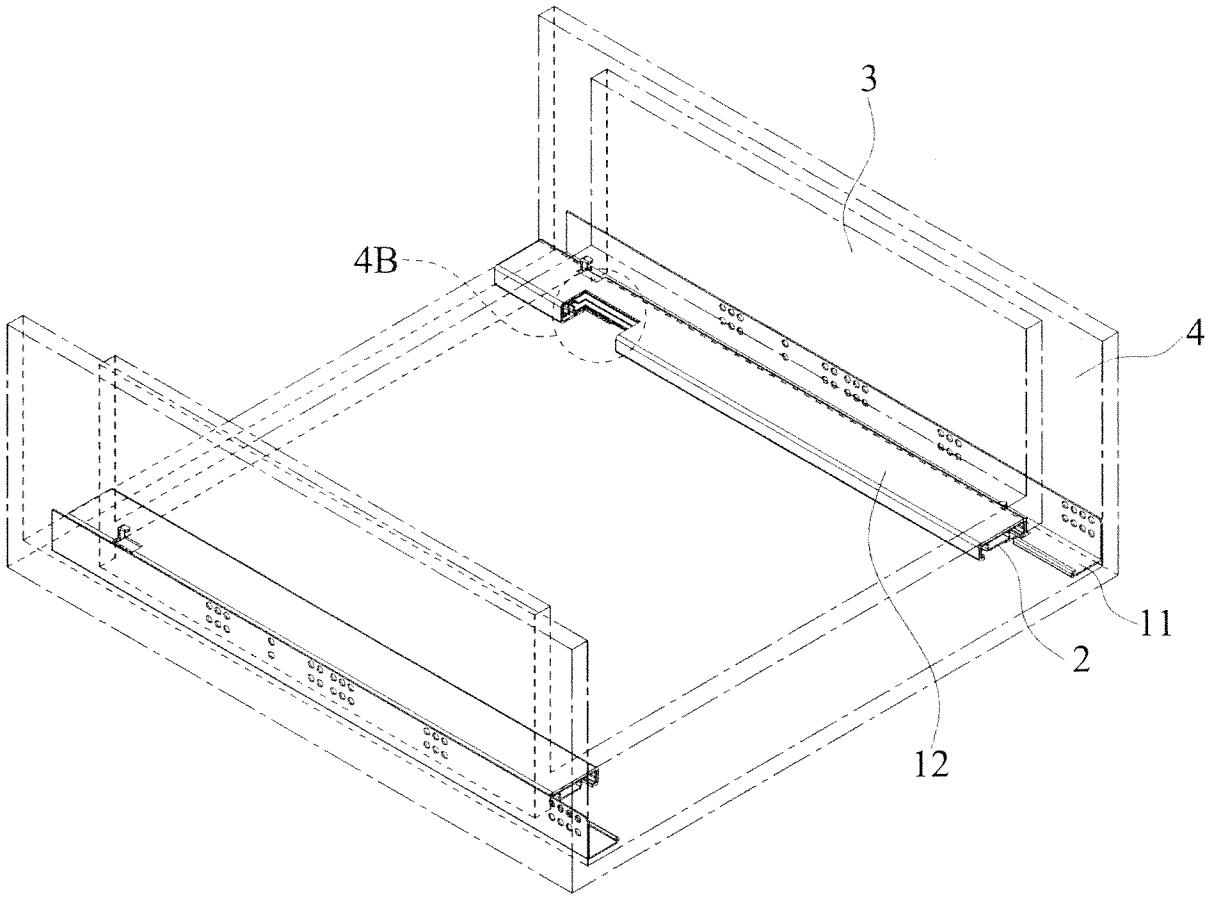
FIG. 4A is a first schematic view of an application of a preferred embodiment of the present invention.
Figure 4B:
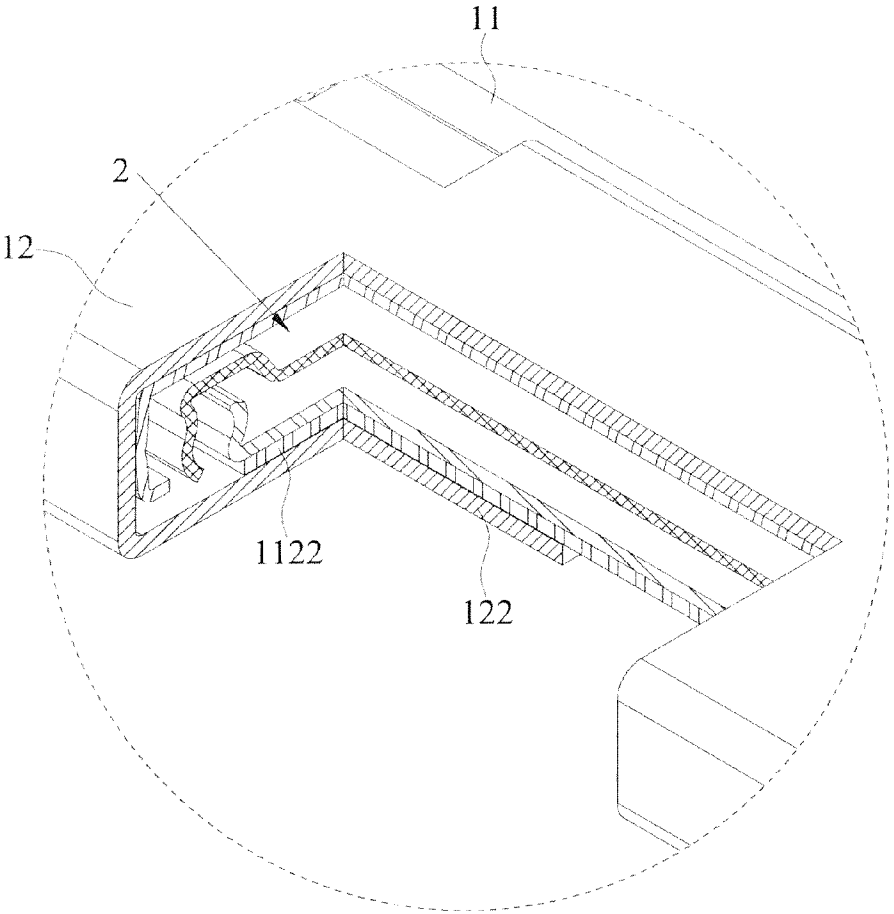
FIG. 4B is a partial blow-up view of a FIG. 4A.
Figure 5A:
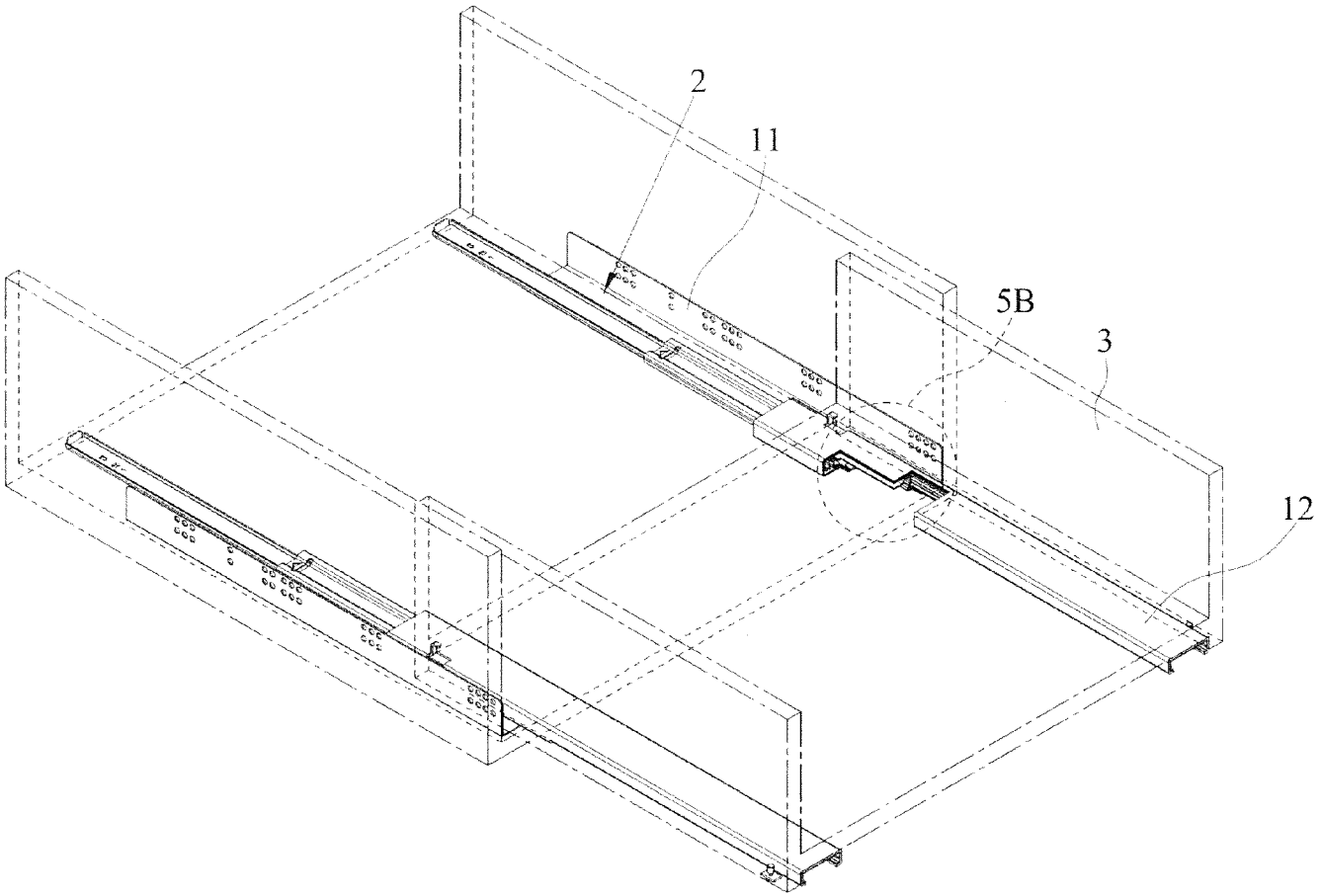
FIG. 5A is a second schematic view of an application of a preferred embodiment of the present invention.
Figure 5B:
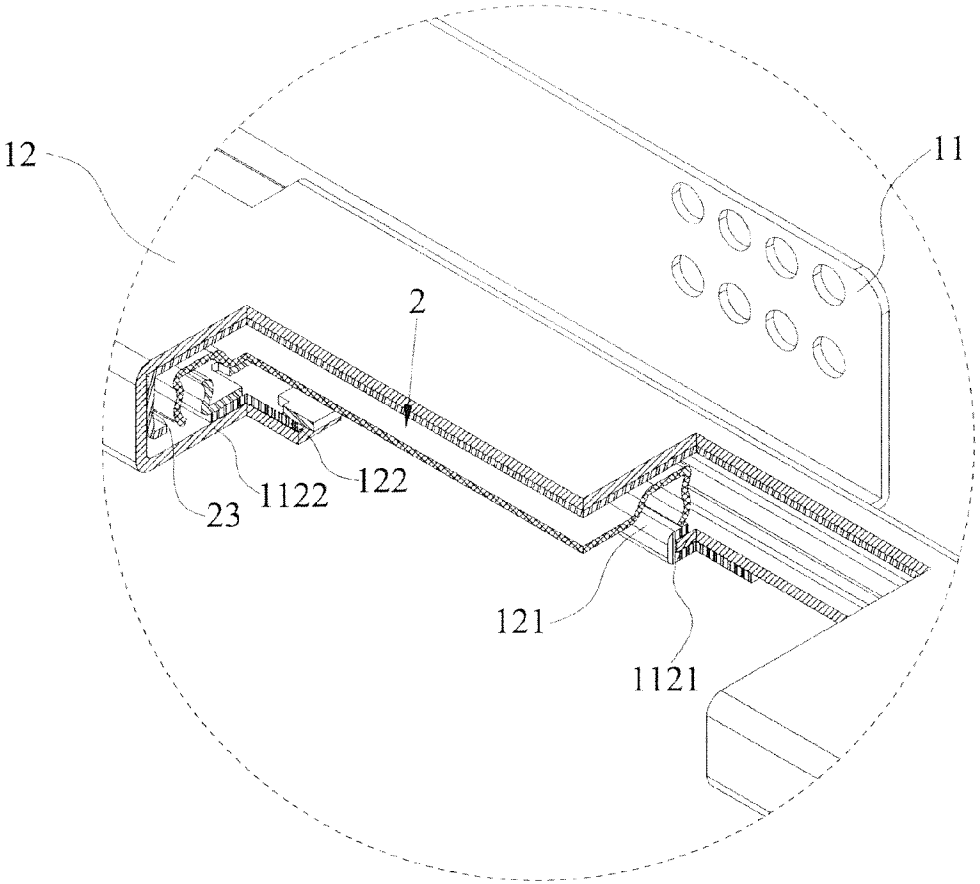
FIG. 5B is a partial blow-up view of a FIG. 5A.

With reference to FIGS. 4A, 4B, 5A and 5B for schematic views and corresponding partial exploded views of different applications in accordance to a preferred embodiment of the present invention respectively as well as FIG. 1, the fixing rack 11 fixed inside the cabinet 4 is a fixed component, and the external frame 12 fixed to the bottom of the drawer 3 is a movable component and can be moved synchronously with the outer rail 23 in an application of the adapter kit 1 of the present invention. In FIGS. 4A and 4B, when the drawer 3 is accommodated in the cabinet 4, the slide module 2 is in an accommodation status, and the external frame 12 and the fixing rack 11 are engaged and situated at the accommodation status, and the inner surface of the second bent portion 122 is maintained to be abutted against the outer surface of the level difference portion 1122, and the design of the second support structure assures the stability of the accommodation of the drawer 3. In FIGS. 5A and 5B, when the drawer 3 is pulled open for its use, the external frame 12 is pulled out together with the outer rail 23. During the process, the inner surface of the second bent portion 122 is maintained to be abutted against the outer surface of the level difference portion 1122, and the design of the second support structure assures the stability of the movement of the drawer 3. When the drawer 3 is pulled out to its maximum distance, the design of the first support structure comprised of the first bent portion 121 and the folded portion 1121 latched with each other can further provide the required support. It is noteworthy that the major feature of the present invention is to combine the use of the present invention with a general slide module 2 available in the market, such as the slide module 2 having other functions including the automatic closing function and the buffering function, or the closing and buffering functions with hydraulic, pneumatic and hydraulic/pneumatic buffering components. When the adapter kit of the present invention is used together with a general slide module, the functionality and value of the application of the adapter kit are improved without sacrificing the original functions of the adapter kit.

What is claimed is:

1. An adapter kit of a slide module, installed between a drawer and a cabinet, and the slide module being hidden and installed at a bottom of the drawer, and the slide module at least having an inner rail, an outer rail and a slide element, and the slide element being installed between the inner rail and the outer rail, and the outer rail being moved linearly with respect to the inner rail, and the adapter kit comprising:

a fixing rack, having a first side board and a second side board disposed on two sides of the fixing rack respectively to form an L-shaped structure, and the first side board having a plurality of first fixing holes for mounting the first side board onto an inner side of the cabinet, and the second side board having at least one folded portion and at least one level difference portion, and the level difference portion having a plurality of second fixing holes corresponding to the inner rail, for fixing the inner rail to the level difference portion; and an external frame, covered onto the exterior of the outer rail and coupled to the fixing rack, and a top of the external frame being fixed to the bottom of the drawer, and the external frame having a first bent portion coupled to an edge of the folded portion, and the first bent portion and the folded portion being latched with each other to form a first support structure, and the external frame having a second bent portion coupled to an edge of the level difference portion, and an inner surface of the second bent portion being coupled to an outer surface of the level difference portion to form a second support structure.

2. The adapter kit of the slide module according to claim 1, further comprising at least one positioning hook installed at an end of the external frame and in a direction towards the other end, and the drawer having a first positioning hole formed at a position corresponding to the positioning hook, such that when the drawer is assembled, the positioning hook is latched into the first positioning hole.

3. The adapter kit of the slide module according to claim 1, wherein the external frame has a latch portion formed separately at two edges of the external frame, and the latch portions are formed by bending a section of each latch portion adjacent to the edge of the external frame towards the center of each latch portion, and the outer rail is covered completely in the latch portion.

4. The adapter kit of the slide module according to claim 1, further comprising an adjusting structure installed on a side of the external frame, and the adjusting structure including an adjusting plate and an adjusting screw, and the adjusting plate being extended outwardly from the external frame, and the adjusting plate having a screw hole for screwing the adjusting screw, and the drawer having a second positioning hole formed at a position corresponding to the adjusting screw, and an end of the adjusting screw being accommodated in the second positioning hole for adjusting a gap of the drawer with respect to the cabinet.

5. The adapter kit of the slide module according to claim 4, wherein the adjusting screw has a prop member disposed at an end of the adjusting screw and installed into the second positioning hole.

6. The adapter kit of the slide module according to claim 1, wherein the level difference portion has a height corresponding to a thickness of the second bent portion.

7. The adapter kit of the slide module according to claim 6, further comprising at least one positioning hook installed at an end of the external frame and in a direction towards the other end, and the drawer having a first positioning hole formed at a position corresponding to the positioning hook, such that when the drawer is assembled, the positioning hook is latched into the first positioning hole.

8. The adapter kit of the slide module according to claim 6, wherein the external frame has a latch portion formed separately at two edges of the external frame, and the latch portions are formed by bending a section of each latch portion adjacent to the edge of the external frame towards the center of each latch portion, and the outer rail is covered completely in the latch portion.

9. The adapter kit of the slide module according to claim 6, further comprising an adjusting structure installed on a side of the external frame, and the adjusting structure including an adjusting plate and an adjusting screw, and the adjusting plate being extended outwardly from the external frame, and the adjusting plate having a screw hole for screwing the adjusting screw, and the drawer having a second positioning hole formed at a position corresponding to the adjusting screw, and an end of the adjusting screw being accommodated in the second positioning hole for adjusting a gap of the drawer with respect to the cabinet.

10. The adapter kit of the slide module according to claim 9, wherein the adjusting screw has a prop member disposed at an end of the adjusting screw and installed into the second positioning hole.

11. The adapter kit of the slide module according to claim 1, wherein the folded portion is disposed at an end position of a movement track of the outer rail.

12. The adapter kit of the slide module according to claim 1, wherein the level difference portion has a length corresponding to a moving distance of the slide module, and the second bent portion has a length within 25%~50% of the length of the level difference portion.

* * * * *